US007766205B2

(12) United States Patent
Calvet et al.

(10) Patent No.: US 7,766,205 B2
(45) Date of Patent: Aug. 3, 2010

(54) MANUALLY CONTROLLED, GAS-OPERATED TOOL HAVING A REAL-TIME CLOCK

(75) Inventors: Pierrick Calvet, Saint Nazaire les Eymes (FR); Florent La Bella, Romans sur Isere (FR); Pascale Grandjean, Valence (FR); Nicolas Guihard, Caluire et Cuire (FR)

(73) Assignee: Societe de Prospection et d'Inventions Techniques Spit, Bourg les Valence (FR)

( * ) Notice: Subject to any disclaimer, the term of this patent is extended or adjusted under 35 U.S.C. 154(b) by 92 days.

(21) Appl. No.: 12/089,740

(22) PCT Filed: Oct. 12, 2006

(86) PCT No.: PCT/IB2006/002852

§ 371 (c)(1),
(2), (4) Date: May 13, 2008

(87) PCT Pub. No.: WO2007/042922

PCT Pub. Date: Apr. 19, 2007

(65) Prior Publication Data

US 2008/0237290 A1 Oct. 2, 2008

(30) Foreign Application Priority Data

Oct. 14, 2005 (FR) ..... 05 10477

(51) Int. Cl.
*B25C 1/08* (2006.01)
*B25C 1/04* (2006.01)

(52) U.S. Cl. ..... 227/8; 227/2; 227/10; 227/156

(58) Field of Classification Search ..... 227/2, 227/7, 8, 10, 156, 134
See application file for complete search history.

(56) References Cited

U.S. PATENT DOCUMENTS 4,051,351 A 9/1977 Mallick, Jr. et al.
5,500,783 A * 3/1996 Warda et al. ..... 361/179
5,918,788 A * 7/1999 Moorman et al. ..... 227/8

(Continued)

FOREIGN PATENT DOCUMENTS

DE 19921521 C1 12/2000
EP 1207016 A 5/2002

OTHER PUBLICATIONS

ISR for PCT/IB2006/002852 mailed Mar. 5, 2007.

*Primary Examiner*—Paul R Durand
(74) *Attorney, Agent, or Firm*—Lowe Hauptman Ham & Berner, LLP

(57) ABSTRACT

The tool includes a cylinder inside of which is slidably mounted a piston for driving a fastening element, as a result of the explosion inside of a combustion chamber of a mixture of gas and air that has been injected therein from a gas cartridge, after which the tool has come to bear weight against a support, the head switch has retracted and the combustion chamber has closed, followed by actuation of the trigger switch for controlling the spark plug. The tool also includes an element for determining the rate of fire which includes a real-time clock designed to cooperate with a microcontroller of an operating and control module. The arrangement applies well to fastening tools.

6 Claims, 3 Drawing Sheets

U.S. PATENT DOCUMENTS 6,123,241 A * 9/2000 Walter et al. ..... 227/8
2002/0060082 A1 5/2002 Watanabe
2004/0026475 A1 * 2/2004 Ohmori ..... 227/10
2004/0182336 A1 * 9/2004 Ohmori et al. ..... 123/46 R
2005/0000998 A1 1/2005 Grazioli et al.
2005/0029323 A1 * 2/2005 Shima et al. ..... 227/10

* cited by examiner

MANUALLY CONTROLLED, GAS-OPERATED TOOL HAVING A REAL-TIME CLOCK

RELATED APPLICATIONS

The present application is based on International Application Number PCT/IB2006/002852 filed Oct. 12, 2006, and claims priority from French Application Number 05 10 477 filed Oct. 14, 2005, the disclosures of which are hereby incorporated by reference herein in their entirety.

FIELD OF THE INVENTION

This invention relates to a manually controlled and gas-operated tool, of the fastening tool type, such as a nailing gun or stapler.

BACKGROUND OF THE INVENTION

The tool comprises a cylinder inside of which is a slidably mounted piston for driving a fastening element, such as a nail or staple, as a function of the explosion inside of a combustion chamber of a mixture of gas and air that has been injected therein from a gas cartridge, after setting the tool into abutment, retraction of the fastener guide and closing of the combustion chamber followed by actuation of the trigger mechanism for controlling the spark plug.

Other than a device for transmitting the gas from the cartridge into the chamber, generally a solenoid valve, the tool further comprises a housing for receiving a battery, a fan for mixing the air and gas of the combustion chamber, a driving motor for the fan, possibly a temperature control module, and an operating and control module for the tool.

The operating and control module carries out its functions which are, in particular, the air-gas mixture, gas control, ignition, firing control, cooling, control of the electrical supply, and failure detection.

In short, a gas-operating tool such as this requires a particular level of attention, all the more so as the service life of the tool may be marked by numerous events, and breakdowns may be multiple and varied.

SUMMARY OF THE INVENTION

The applicant has sought to make life easier for the operators and by burning in these gas-operated tools as best as possible.

Therefore, the invention relates to a tool of the type described above, characterised by the fact that it comprises means for determining the rate of fire, which can trigger the means for locking the tool, in the case where the rate is too high to proper functioning of the tool.

The locking means may include:

means for locking ignition means for locking the injection of gas into the chamber, means for locking control switches for injection and ignition (head switch-fastener guide and trigger switch-trigger mechanism).

Preferably, the means for determining the rate of fire include a real-time clock designed to cooperate with a microcontroller for the operating and control module.

The clock provides a means to date the various firings, establish a chronology and determine the interval of time between firings.

In a general sense, the integration of the real-time clock makes it possible to date the various events in the service life of the tool and the firings, but also to date the moments when the various breakdowns occur. This may enable exact knowledge of the conditions of use of the tool, if it is used regularly for a few firings, or occasionally, for numerous firings. This also serves in the detection of intermittent breakdowns.

Advantageously, a backing storage is provided for the tool's operational data, which cooperates with the microcontroller and the clock in order to control the locking means.

BRIEF DESCRIPTION OF THE DRAWINGS

The invention will be better understood with the help of the following description, in reference to the appended figure in which.

DETAILED DESCRIPTION OF THE DRAWINGS

Figure 1:
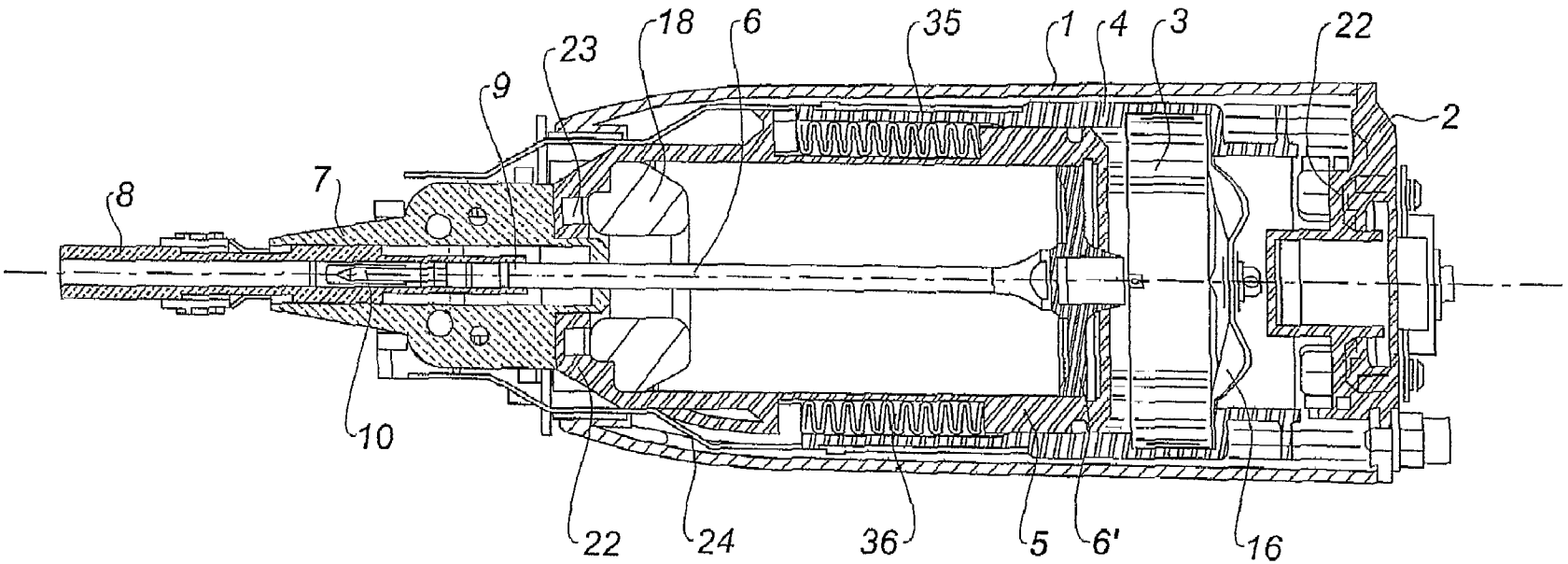
FIG. 1 is an axial cross-section of the preferred embodiment of the invention.
Figure 2:
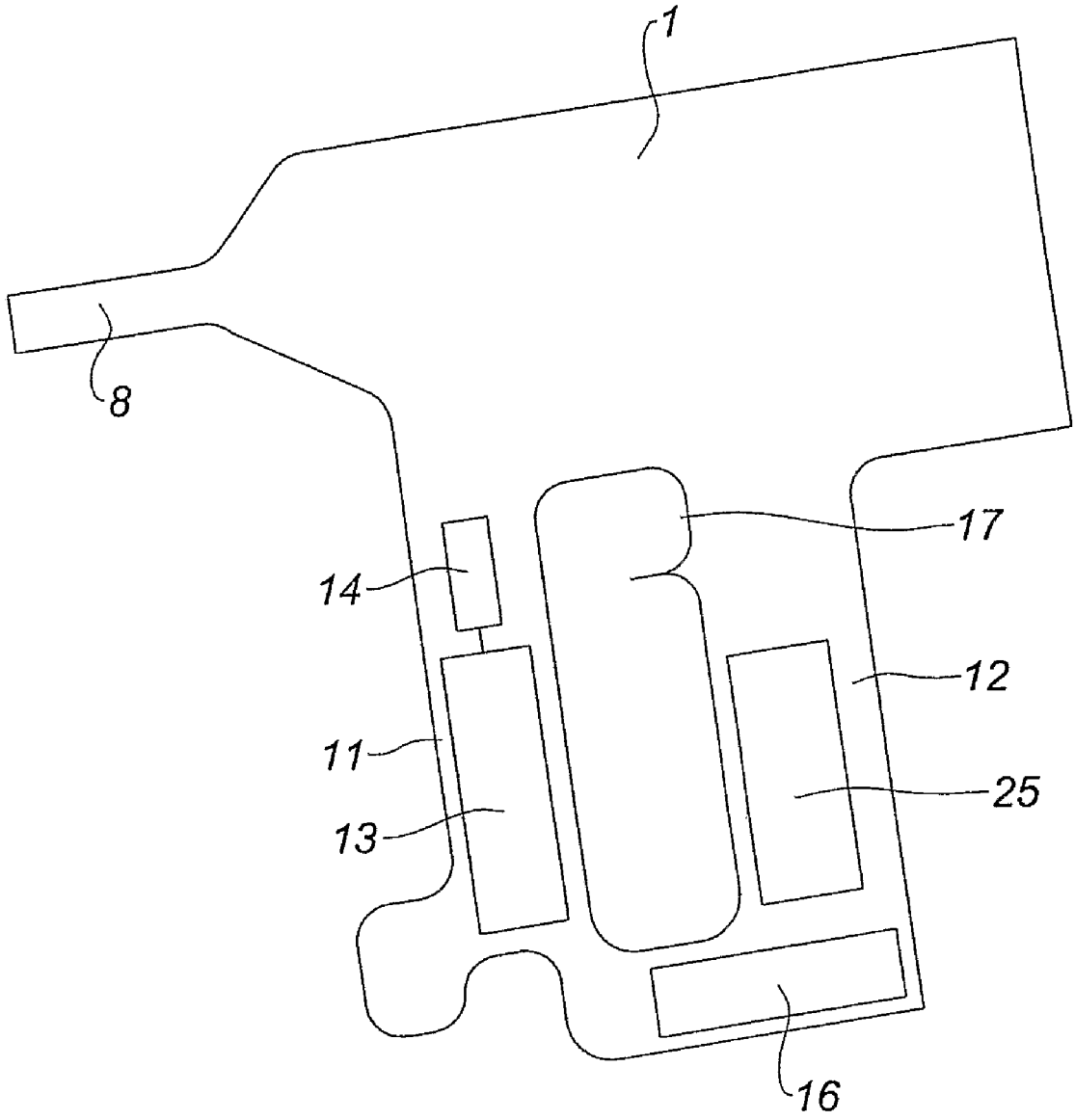
FIG. 2 is a schematic profile view of the tool of FIG. 1, with half of the housing shell removed and, FIG. 3 is a flowchart of the circuits, and, in particular, of the locking circuits, of the operating and control card of the tool of the invention.
Figure 3:
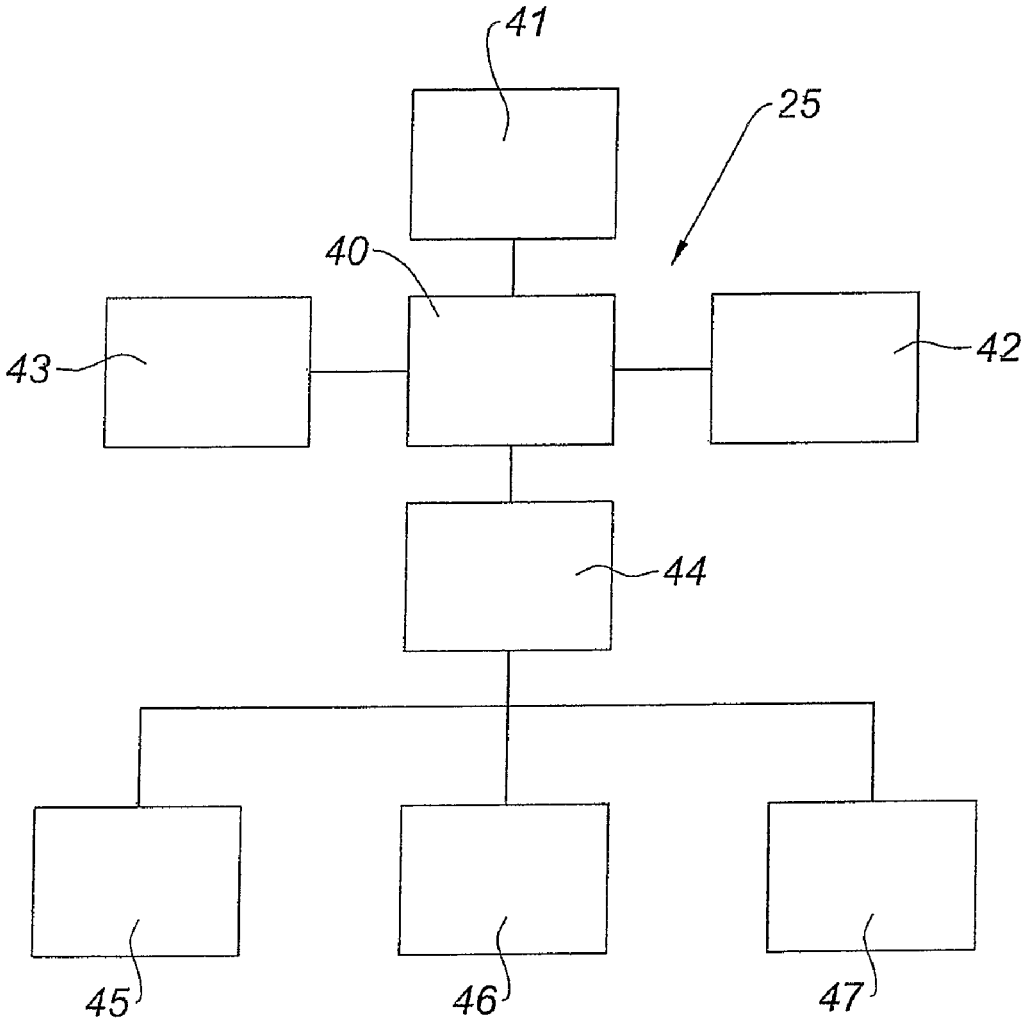

In reference to FIG. 1, the device conventionally comprises inside a housing 1, a rear breech 2, a combustion chamber 3, a combustion chamber sleeve 4, a cylinder 5, a piston 6, a head switch (fastener guide) 8 and a fastener support 7. The head switch 8 serves to sense the bearing of weight and closure of the combustion chamber 3.

The combustion chamber sleeve 4 is slidably mounted on the cylinder 5, and closes the combustion chamber 3 at the front and back, together with the piston 6 and the cylinder 5. The piston 6, equipped with a posterior head 6', is slidably mounted inside the cylinder 5, which is integral within the housing 1. The head switch 8, protruding from the housing 1 at the front, is slidably mounted inside the fastener support 7, which is integral within the housing 1.

At its front, the cylinder 5 contains a recoil buffer 18, integral with the cylinder 5, against which the head 6' of the piston <6, propelled forward during firing, is intended to abut and, at its rear, a mixing fan 16.

All of these elements of the device have a common axis 9.

Springs 35, 36 are intended to bring the sleeve 4 forward in normal position, when the device no longer bears weight against a support. When the device is in normal position,—the sleeve 4 and the head switch 8 are brought forward by the springs 35, 36 and the combustion chamber 3 is open at the rear.

In this case, a nail magazine, not shown, but extending into the front handle 11 of the device, communicates with the head switch 8, for loading nails 10 into the head switch 8.

The device comprises a piezoelectric sensor 23 between the front traverse bottom of the cylinder 5 and the recoil buffer 18, at the front of the latter.

The sensor 23 is electrically connected to a computing module that is arranged on an electronic board 25 which, in this case, is arranged inside the back handle 12 of the device, and substantially comprising operating and control circuits for the device. The sensor 23 is a shock and firing detector.

A gas cartridge 13 as well as the solenoid valve 14 for admitting gas into the chamber 13 are also housed inside the front handle 11 of the device.

Finally, the battery 16 is housed inside a branch 15 forming a bridge between the two handles 11, 12. A spark plug and ignition device, not shown, controlled by a trigger device 17, feeds into the chamber 3.

The operating and control card comprises, in particular, a microcontroller 40, a real-time clock 41, a memory circuit 42, a warning device 43 and locking circuits 44, all of these elements and components being connected to the microcontroller 40.

As already indicated above, the clock 41, in cooperation with the microcontroller 44, makes it possible to date the various events in the service life of the tool, the number of firings, and the failures of the various parts of the tool, that are important 'to know for those who will be responsible for' after-sales service, and for troubleshooting purposes.

The installation of the clock 41, in addition to a quartz crystal in this case, involves the addition of an emergency power supply that can be provided by a back-up battery or a high-capacity capacitor.

In this case, the information is stored in an E2PROM technology memory circuit 42. The memory 42 communicates here again by means of the I2C protocol. The implantation of this memory 42 makes it possible to preserve the harvested information in the absence of a supply voltage and enables the data to be deleted electrically by the microcontroller 40. This formatting can be decided by the microcontroller if the storage space becomes insufficient, by applying the FIFO principal.

The dating of the various firings by the clock 41, in cooperation with the memory circuit 42 and the microcontroller 40, makes it possible to establish a chronology and to determine the interval of time between two firings. This information thus processed by the microcontroller 40 makes it possible to determine if the rate of fire selected by the user is not too high and does not thereby risk damaging the tool in the long run.

The detection of too high a rate of fire, signalled to the user by the warning device 43, controls the locking of the tool by the circuit 44 and can be anticipated in three different ways:

locking ignition 45: with no spark being produced by the spark plug, there is no explosion of the air-gas mixture and therefore no firing;

locking injection 46 of the gas: with the gas not being, injected—into the combustion chamber 3 by the solenoid valve 14, there is no explosion and therefore no firing;

locking 47 the operation of the injection 8 and ignition 17 control switches: this locking operation makes it possible to block the injection of the gas and the production of the spark plug's spark.

The invention claimed is:

1. Manually controlled and gas-operated tool, comprising:

a cylinder;

a combustion chamber at a rear of the cylinder for receiving a combustible mixture;

a spark plug for igniting the combustible mixture injected into the combustion chamber;

a fastener guide at a front of the cylinder for guiding a fastener into a material to be fastened, said fastener guide being retractable upon abutment with the material for closing the combustion chamber;

a trigger mechanism for controlling the spark plug to fire the tool;

a piston slidably mounted inside the cylinder for driving the fastening element forward through the fastener guide, under the action of the explosion inside of the combustion chamber of the mixture of gas and air that has been injected therein after retraction of the fastener guide and closing of the combustion chamber, followed by actuation of the trigger mechanism for controlling the spark plug to fire the tool;

a locking element for locking the firing of the tool; and a rate determining element for determining if the rate of fire of the tool is in excess of an acceptable limit, and activating the locking element for locking the tool in response to said determination.

2. Tool according to claim 1, wherein the locking element comprises in which an element for locking ignition of the combustible mixture.

3. Tool according to claim 2, wherein the locking element further comprises an element for locking the injection of gas into the combustion chamber.

4. Tool according to claim 3, wherein the locking element further comprises an element for locking the fastener guide and the trigger mechanism.

5. Tool according to claim 1, further comprising a microcontroller for controlling the locking element;

wherein the rate determining element includes a real-time clock coupled to cooperate with the microcontroller.

6. Tool according to claim 5, further comprising a memory for storing the tool's operational data, said memory being coupled to the microcontroller for cooperating with the microcontroller and the clock in order to control the locking element.

* * * * *